US006343537B1

(12) United States Patent
Iida et al.

(10) Patent No.: US 6,343,537 B1
(45) Date of Patent: Feb. 5, 2002

(54) DUAL STROKE CYLINDER

(75) Inventors: Kenji Iida; Akihiro Hirano, both of Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/702,670

(22) Filed: Nov. 1, 2000

(30) Foreign Application Priority Data

Nov. 22, 1999 (JP) ..... 11-331468

(51) Int. Cl.[7] ..... F15B 15/24
(52) U.S. Cl. ..... 092/13.1; 92/13.4; 92/13.6
(58) Field of Search ..... 91/169; 92/13.1, 92/13.4, 13.6

(56) References Cited

U.S. PATENT DOCUMENTS 4,072,087 A * 2/1978 Mueller ..... 92/13.1
4,773,300 A * 9/1988 Klatt et al. ..... 91/169

FOREIGN PATENT DOCUMENTS

WO 82/03896 * 11/1982 ..... 92/13.1

* cited by examiner

*Primary Examiner*—F. Daniel Lopez
(74) *Attorney, Agent, or Firm*—Oblon, Spivak, McClelland, Maier & Neustadt, P.C.

(57) ABSTRACT

A piston 14 for sliding in a cylinder 12, a rod 16 of the piston 14, and a sleeve 15 fitted over the rod 16 and passing through a rod hole 13 of the cylinder are provided. A lock portion 18 is provided to an outer periphery of a tip end portion of the rod 16. The sleeve 15 having an outer peripheral face for airtightly sliding in the rod hole 13 in the cylinder 12 and an inner peripheral face for airtightly sliding on an outer peripheral face of the rod 16 is provided with an engaging portion 22 on an inner end side to be engaged with an inside of the rod hole 13 of the cylinder and an engaging portion 23 at an outer end side to be engaged with the lock portion 18 of the rod 16. Supply/discharge ports 18A and 19A for supplying and discharging pressure fluid to and from pressure chambers 18 and 19 on opposite sides of the piston 14 in the cylinder are provided and intermediate stop is possible by supplying and discharging pressure fluid to and from the ports.

7 Claims, 5 Drawing Sheets

DUAL STROKE CYLINDER

TECHNICAL FIELD

The present invention relates to a dual stroke cylinder for stopping a piston in an intermediate position of a stroke and more specifically to a dual stroke cylinder for stopping a piston in an intermediate position of a stroke in a fluid pressure cylinder that is used for lifting such that a load is pushed up or pulled up by a rod of the piston or not for lifting such that the rod does not directly receive a weight of the load.

PRIOR ART

In a normal fluid pressure cylinder, a rod moves from a beginning to an end of a stroke at a single stroke. However, it is desired that the rod is once stopped in an intermediate position of the stroke with certain operation being done by that time and that the rod is then moved to the stroke end where operation in the next stage is done.

If the fluid pressure cylinder is controlled by a solenoid valve, energization of the solenoid valve may be interrupted by an unexpected accident. In such a case, a part of an operator's body may be pinched by a workpiece or the like mounted to the rod at the beginning or end of the stroke of the rod. As a safeguard for preventing such a problem, it is more advantageous to use a fluid pressure cylinder in which a rod can stop in an intermediate position that is a non-energized home position than to use a lock mechanism or a three-position valve.

FIG. 8 shows an example of a known dual stroke cylinder in which a rod can stop in an intermediate position of a stroke. In the dual stroke cylinder, a first cylinder 1A having a first piston 2A with a stroke S1 and a first rod 3A and a second cylinder 1B having a second piston 2B with a stroke S2 that is larger than the stroke S1 and a second rod 3B are concentrically connected in series and a tip end of the first rod 3A airtightly passes through covers of the cylinders 1A and 1B to come in contact with the second piston 2B.

In this dual stroke cylinder, in a state shown in FIG. 8 in which the first and second pistons 2A and 2B and the first and second rods 3A and 3B are in return stroke end positions, if compressed air is supplied from a port 5A to a head-side cylinder chamber 7A of the first piston 2A, the first piston 2A and the first rod 3A move leftward in FIG. 8 by the stroke S1 and stop and the second piston 2B and the second rod 3B are pushed by the first rod 3A and move leftward by the stroke S1.

Then, if compressed air is supplied from a port 5B to a head-side cylinder chamber 7B of the second cylinder 1B, the second piston 2B and the second rod 3B further move leftward by a stroke (S2–S1) and stop.

Therefore, it is possible to stop the rod 3B of the second cylinder 1B in an intermediate position of the stroke S1.

If compressed air is supplied respectively from a port 6B to a rod-side cylinder chamber 8B of the second cylinder 1B and from a port 6A to a rod-side cylinder chamber 8A of the first cylinder 1A and compressed air in the head-side cylinder chambers 7A and 7B of the cylinders 1A and 1B is discharged to an outside, the second piston 2B and the second rod 3B move rightward by the stroke S2 and the first rod 3A and the first piston 2A move rightward by the stroke S1, thereby returning to the state shown in FIG. 8.

The port 6A on a rod side of the first cylinder 1A may be a breathing port.

Although the rod 3B can stop in the intermediate position of the stroke in the above dual stroke cylinder, the cylinder is formed by connecting the two cylinders 1A and 1B in series, which complicates the structure and increases the number of parts and cost. Moreover, it is necessary to control supply and discharge of compressed air to and from at least the respective ports 5A, 5B, and 6B of the two cylinders 1A and 1B and a structure of a system for controlling supply of the compressed air including pipe connection is complicated.

DISCLOSURE OF THE INVENTION

It is a main object of the present invention to provide a dual stroke cylinder in which a structure and a structure of a system for controlling supply of compressed air are simple, the number of parts is small, and cost can be reduced.

It is another object of the invention to provide a dual stroke cylinder in which a rod can stop not only in full-stroke positions but also in an intermediate stop position only by supply of compressed air to two ports.

To achieve the above objects, according to the invention, there is provided a dual stroke cylinder having a sleeve for intermediate stop and passing for sliding through a rod hole in a cylinder body, with a rod passing for sliding through the sleeve.

A base end portion of the sleeve is positioned in a rod-side pressure chamber and has a pressure receiving portion with a diameter smaller than that of the piston. The sleeve is stopped by stop means in the position when the sleeve moves to a forward end. Between the rod and the sleeve, first lock means for locking the rod and the sleeve to each other at a rearward end when the rod moves rearward relatively to the sleeve and second lock means for locking the rod and the sleeve to each other at a forward end when the rod moves forward relatively to the sleeve are provided.

According to a concrete embodiment of the invention, the stop means is a flange portion formed on an outer periphery of the base end portion of the sleeve and the flange portion is locked to an inner end of the rod hole in the cylinder body at the forward end.

According to another concrete embodiment of the invention, the first lock means is a large-diameter portion formed at the tip end of the rod, the large-diameter portion comes into contact with the tip end portion of the sleeve at the rearward end of the rod, the second lock means is the piston, and the piston comes into contact with a rear end portion of the sleeve at the forward end of the rod.

The dual stroke cylinder can be used for lifting such that a load is lifted or lowered by pushing the load up or by pulling the load up by the rod. The dual stroke cylinder can be used not for lifting such that the piston does not directly receive a weight of the load in the intermediate stop position.

If the cylinder is used as a lift for pushing up, pressure fluid of equal pressure is supplied to the head-side pressure chamber and the rod-side pressure chamber through the ports. If the cylinder is used as a lift for pulling up, pressure fluid of lower pressure is supplied to the head-side pressure chamber, pressure fluid of higher pressure is supplied to the rod-side pressure chamber, and a difference between the pressures of the fluid is maintained at such a value that the piston can stop in the intermediate stop position. If the cylinder is used not for lifting, the pressure fluid of lower pressure is supplied to the head-side pressure chamber, pressure fluid of higher pressure is supplied to the rod-side pressure chamber, and a difference between the pressures of the fluid is maintained at such a value that the piston can stop in the intermediate stop position.

DETAILED DESCRIPTION

Figure 1:
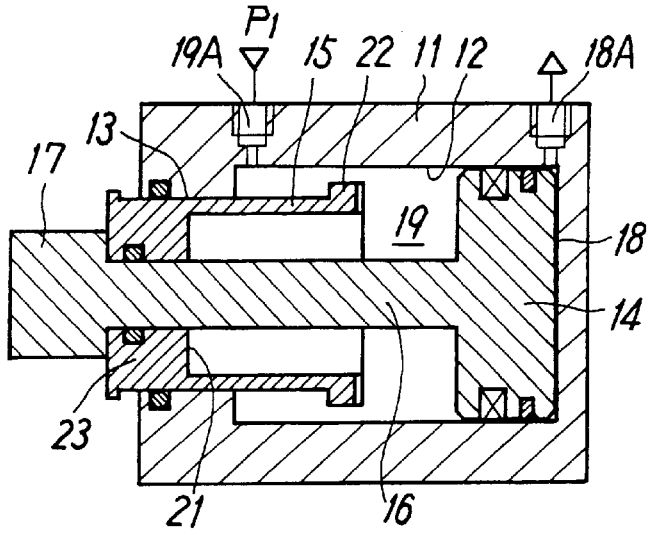
FIG. 1 is a sectional view of an embodiment of the present invention in a state in which a piston and a rod are at a rearward end.
Figure 2:
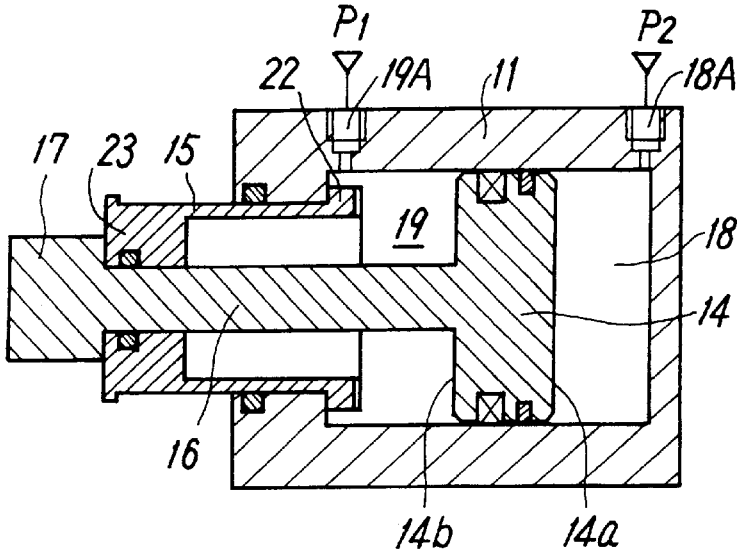
FIG. 2 is a sectional view showing a state in which the piston and the rod are in an intermediate stop position.
Figure 3:
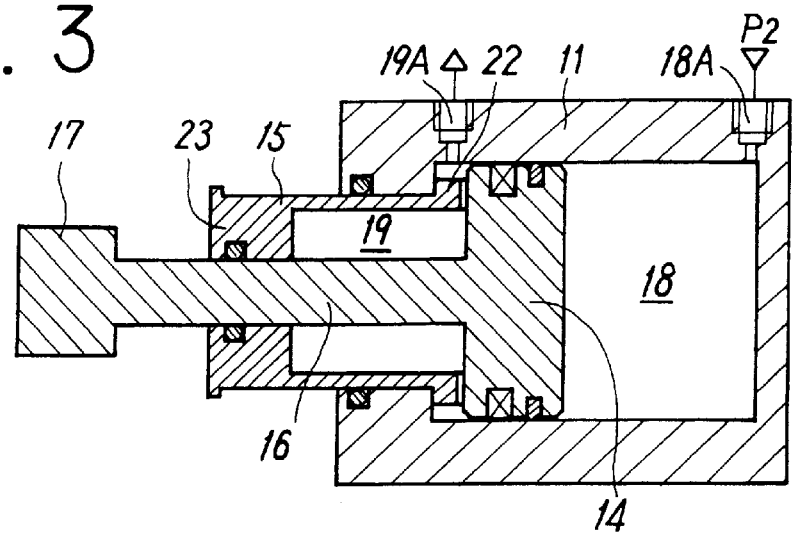
FIG. 3 is a sectional view showing a state in which the piston and the rod are at a forward end.

FIGS. 1 to 3 show an embodiment of the present invention. The dual stroke cylinder has one cylinder body 11 and has a cylinder bore 12 and a small-diameter rod hole 13 connected to one end of the cylinder bore 12 in the cylinder body 11. A piston 14 is airtightly housed for sliding in the cylinder bore 12 and a sleeve 15 for intermediate stop is airtightly provided for forward and rearward movements in the rod hole 13.

A base end portion of a rod 16 is connected to the piston 14 and a tip end of the rod 16 passes through the sleeve 15 such that the rod 16 can slide airtightly and relatively to the sleeve 15 and extends to an outside of the cylinder body 11. To the tip end of the rod 16, a large-diameter portion 17 that is first lock means to be locked to a tip end portion 23 of the sleeve 15 is provided.

An inside of the cylinder bore 12 is separated into a head-side pressure chamber 18 and a rod-side pressure chamber 19 by the piston 14 and a pair of ports 18A and 19A individually communicating with the respective pressure chambers 18 and 19 are provided to a side face of the cylinder body 11.

The sleeve 15 positioned concentrically with the rod 16 has a base end portion positioned in the rod-side pressure chamber 19 and a tip end portion extending to the outside of the cylinder body 11. A hollow portion 21 is formed in the sleeve 15 on the base end portion side and a face on the base end portion side including the hollow portion 21 is formed as a pressure receiving portion with a diameter smaller than the piston 14.

Between the sleeve 15 and the cylinder body 11, stop means for stopping the sleeve 15 in its position when the sleeve 15 moves to the forward end is provided. The stop means is formed of a flange portion 22 formed on an outer periphery of the base end portion of to sleeve 15 and the flange portion 22 is locked to an inner end of the rod hole 13 of the cylinder body 11 in a position of the forward end of the sleeve 15 as shown in FIG. 2.

Between the rod 16 and the sleeve 15, the first lock means for locking the rod 16 and the sleeve 15 to each other at the rearward end when the rod 16 moves rearward relatively to the sleeve 15 and second lock means for locking the rod 16 and the sleeve 15 to each other at the forward end when the rod 16 moves forward relatively to the sleeve 15 are provided. The first locking means is the large-diameter portion 17 formed at the tip end of the rod 16 and the large-diameter portion 17 comes into contact with the tip end portion 23 of the sleeve 15 at the rearward end of the rod 16 as shown in FIGS. 1 and 2. The second locking means is formed of the piston 14 and the piston 14 comes into contact with the rear end portion of the sleeve 15 at the forward end of the rod 16 as shown in FIG. 3. Therefore, the sleeve 15 can move relatively on the rod 16 between the large-diameter portion 17 and the piston 14.

The above dual stroke cylinder 11 can be used as a lift for lifting and lowering a load at the tip end of the rod 16 by pushing the load up by the rod 16 when the dual stroke cylinder 11 is disposed vertically such that the rod 16 is oriented upward and can be used as a lift for lifting and lowering a load at the tip end of the rod 16 by pulling the load up by the rod 16 when the dual stroke cylinder 11 is disposed such that the rod 16 is oriented downward. Furthermore, the dual stroke cylinder 11 can be used not for lifting such that the piston 14 does not directly receive a weight of the load when the rod 16 is oriented horizontally or in other arbitrary directions.

However, it is necessary to adjust pressure of fluid supplied to the head-side pressure chamber 18 and the rod-side pressure chamber 19 on opposite sides of the piston 14 if necessary in each case. Therefore, operation of the dual stroke cylinder 11 including pressure of the fluid to be supplied to the respective pressure chambers 18 and 19 will be described below.

FIGS. 4A to 4D and 5A to 5D are for explaining operation in a case of using the fluid pressure cylinder as the lift for lifting and lowering a load W at the tip end of the rod 16 in a pushing-up manner. Here, fluid supply means for supplying pressure fluid of equal pressure is connected to the respective ports 18A and 19A. The fluid supply means can be formed of one fluid source and a selector valve connected between the fluid source and the two ports 18A and 19A. In each the drawing, operating forces of fluid pressure to be cancelled out by each other are represented by dotted arrows and operating forces that operate effectively are represented by solid arrows, which will be true for the following drawings.

Figure 4A:
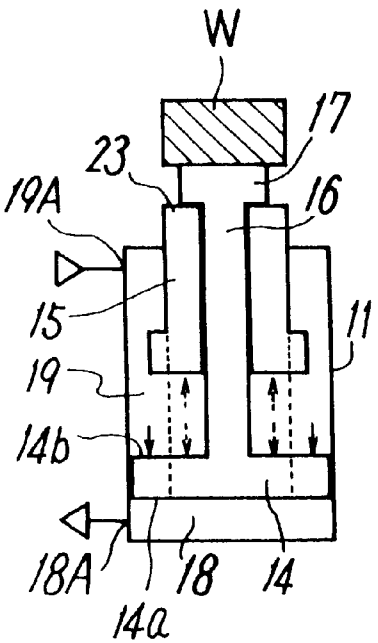
FIGS. 4A to 4D are explanatory views of pushing-up operation of a load when a dual stroke cylinder is used as a lift for pushing the load up by an upward rod.

FIGS. 4A to 4D show operation of a lifting process in which the rod 16 pushes up the load W. In FIG. 4A, compressed air is supplied from the port 19A to the rod-side pressure chamber 19, air in the head-side pressure chamber 18 is discharged from the port 18A to an outside, and the piston 14 and the rod 16 are at the rearward end by operating force of air pressure that acts on the rod-side pressure receiving face 14*b* of the piston 14. In this case, the sleeve 15 is pushed upward by fluid pressure in the pressure chamber 19. Because a pressure receiving area of the rod-side pressure receiving face 14*b* of the piston 14 is larger than a pressure receiving area of the sleeve 15 and the weight of the load W also acts on the rod 16, the sleeve 15 stops in such a position that the tip end portion 23 is engaged with the large-diameter portion 17 of the rod 16.

Figure 4B:
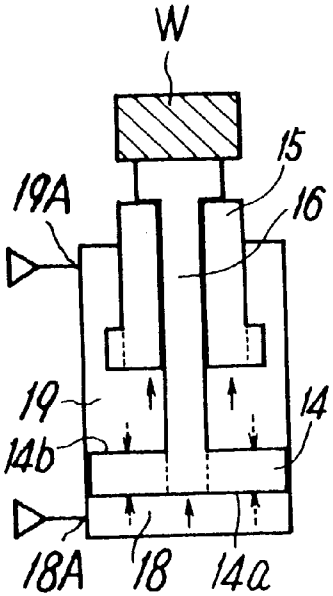

In this state, as shown in FIG. 4B, if compressed air of the same pressure as the rod-side pressure chamber 19 is supplied from the port 18A to the head-side pressure chamber 18, because a pressure receiving area of a head-side pressure receiving face 14*a* of the piston 14 is larger than the rod-side pressure receiving face 14*b* by a sectional area of the rod 16, air pressure operating force corresponding to the sectional area of the rod 16 acts upward on the piston 14. Because air pressure operating force acting upward on the sleeve 15 is added to the above force, the load W is pushed up by the sum of the air pressure operating forces.

Figure 4C:
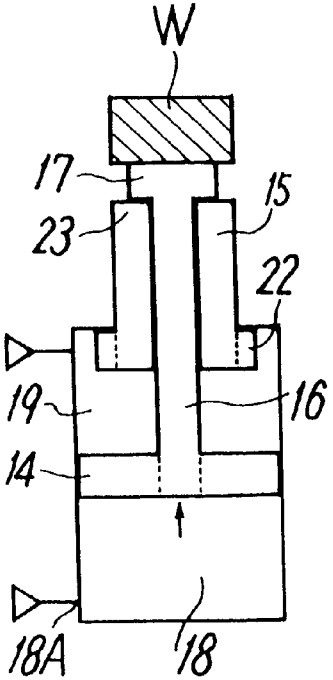

If the piston 14 and the rod 16 move forward with the sleeve 15 and the flange portion 22 of the sleeve 15 comes into contact with an end face of the rod-side pressure chamber 19, operating force for further moving the rod 16 upward is only air pressure operating force corresponding to the sectional area of the rod 16 that acts on the piston 14 as shown in FIG. 4C. Therefore, if the air pressure operating force is smaller than the weight of the load W, the rod 16 stops in the intermediate stop position.

Figure 4D:
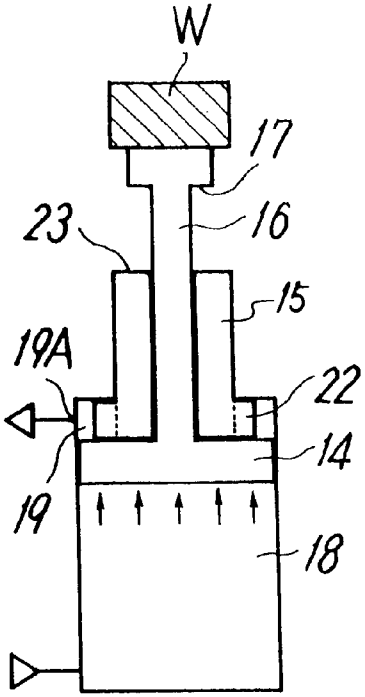

Next, in a state shown in FIG. 4C, if compressed air in the rod-side pressure chamber 19 is discharged to the outside from the port 19A, only operating force due to air pressure in the head-side pressure chamber 18 acts on the rod 16 and pushes the rod 16 upward. Therefore, as shown in FIG. 4D, the piston 14 and the rod 16 further move in a driving direction and stop at a lifting stroke end where the piston 14 is in contact with the base end portion of the sleeve 15.

Operation of a lowering process of the load will be described next by reference to FIGS. 5A to 5D.

Figures 5A, 5B, 5C, 5D:
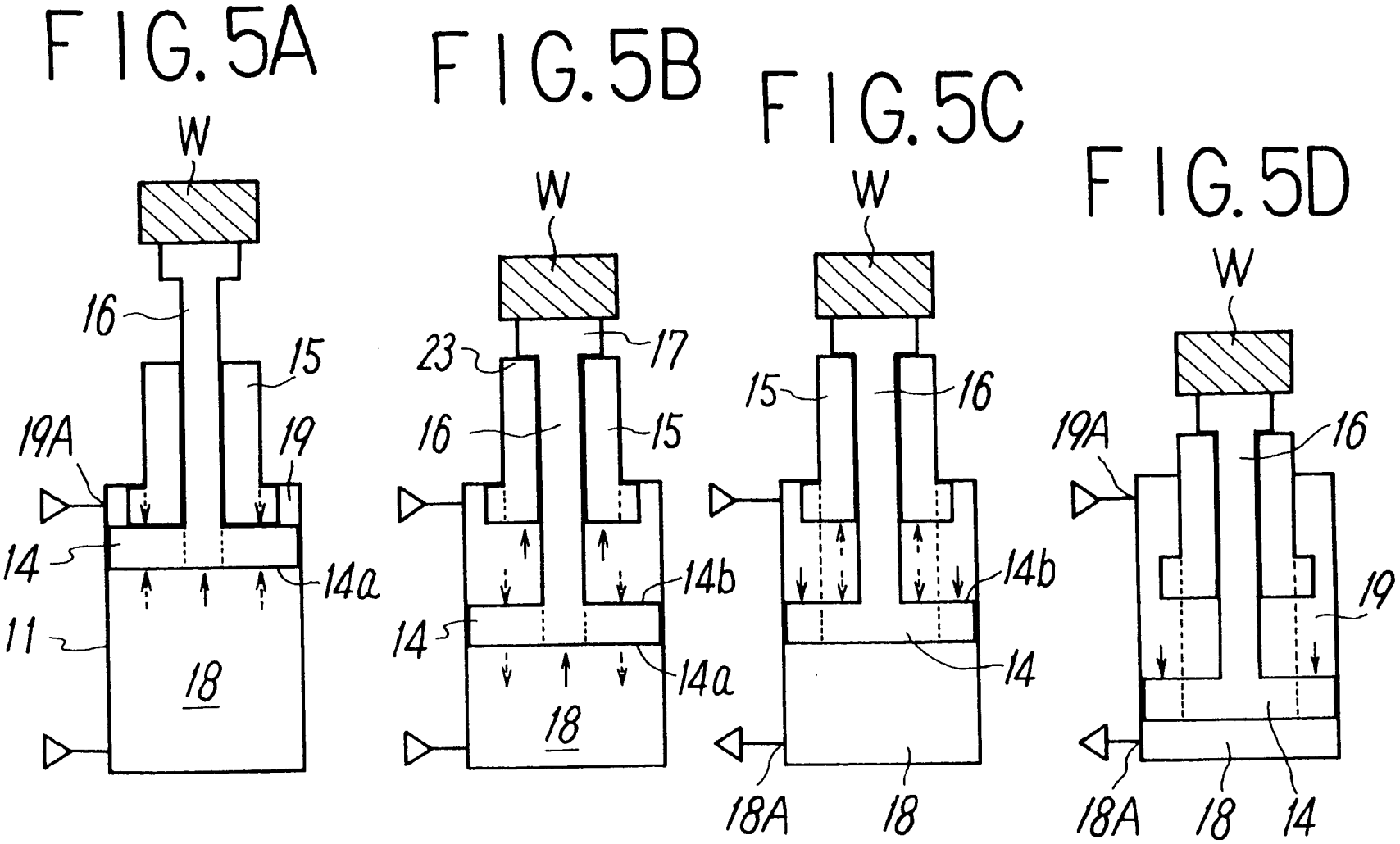
FIGS. 5A to 5D are explanatory views of lowering operation of the load in FIGS. 4A to 4D.

In the above state in which the piston 14 and the rod 16 are at the lifting stroke end, if compressed air is supplied from the port 19A to the rod-side pressure chamber 19 as shown in FIG. 5A, air pressure operating force that acts on the piston 14 upward is only force corresponding to the sectional area of the rod 16. Therefore, the rod 16 moves downward to the intermediate stop position where the large-diameter portion 17 of the rod 16 is engaged with the tip end portion 23 of the sleeve 15 as shown in FIG. 5B. In this state, forces for pushing up the load W are only operating force due to air pressure in the rod-side pressure chamber 19 that acts on the sleeve 15 and force that corresponds to the sectional area of the rod 16 and acts on the head-side pressure receiving face 14*a* of the piston 14 and the load W stops in the intermediate position by the operating forces.

In this state, if compressed air in the head-side pressure chamber 18 is discharged as shown in FIG. 5C, because air pressure operating force that acts on the rod-side pressure receiving face 14*b* of the piston 14 downward is larger than air pressure operating force that acts on the sleeve 15 upward, the load W moves downward and stops in an end position of a return stroke as shown in FIG. 5D.

Although the case in which pressure fluid of the equal pressure is supplied to both the supply/discharge ports 18A and 19A has been described, the pressures supplied to both the ports may be different from each other according to the load and the like. In this case, there are methods of connecting a pressure-regulating valve to one port, connecting fluid sources with different pressures to both the ports, and the like.

Next, by reference to FIGS. 6A to 6C and 7A to 7C, the case in which the above dual stroke cylinder 11 is disposed such that the rod 16 is oriented downward and the dual stroke cylinder 11 is used as the lift for lifting and lowering the load W at the tip end of the rod 16 by pulling up the load W by the rod 16 will be described.

In this case, fluid supply means that can supply pressures to both the supply/discharge ports such that pressure $P_1$ of fluid supplied to the rod-side pressure chamber 19 is higher than pressure $P_2$ of fluid supplied to the head-side pressure chamber 18 by a pressure difference necessary for retaining the piston 14 in the intermediate stop position, both the pressure chambers being defined by the piston 14, is connected to both the ports 18A and 18B.

Figure 6A:
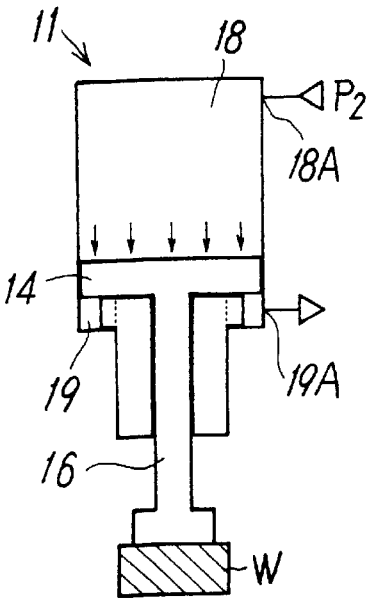
FIGS. 6A to 6C are explanatory views of pulling-up operation when the dual stroke cylinder is used as a lift for pulling the load up by a downward rod.
Figure 6B:
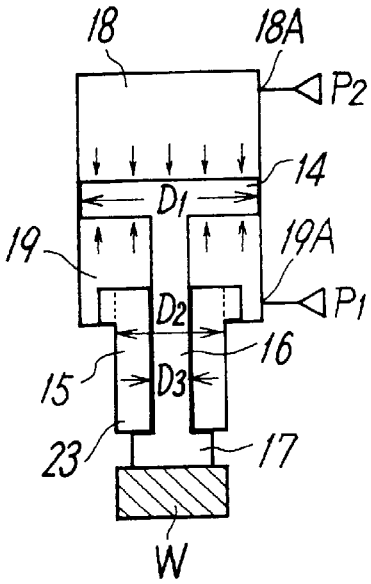
Figure 6C:
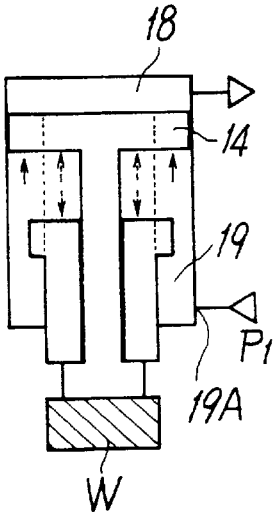

FIGS. 6A to 6C show operation of a lifting process for pulling up the load W by the rod 16. In FIG. 6A, compressed air of pressure $P_2$ is supplied to the head-side pressure chamber 18 from the port 18A, air in the rod-side pressure chamber 19 is discharged to the outside from the port 19A, and the piston 14 and the rod 16 are in the end position of a lowering stroke by operating force of air pressure that acts on the head-side pressure receiving face of the piston 14.

In this state, if compressed air of pressure $P_1$ is supplied from the port 19A to the rod-side pressure chamber 19, the load W is pulled up to the intermediate stop position by the difference between the operating forces of the air pressures that act on the head-side and rod 16 side of the piston 14 as shown in FIG. 6B. After the large-diameter portion 17 at the tip end of the rod 16 is locked to the tip end portion 23 of the sleeve 15, air pressure in the rod-side pressure chamber 19 acting on the sleeve 15 acts on the large-diameter portion 17 as downward force to stop upward movement of the load W.

In this case, if the weight of the load W is represented by mg and diameters of the piston 14, sleeve 15, and rod 16 are respectively represented by $D_1$, $D_2$, and $D_3$, the following relationship is necessary between the pressures $P_1$ and $P_2$. Here, resistance to the piston 14 and the like is ignored.

$$\pi/4\ D_1^2 P_2 + mg < \pi/4(D_1^2 - D_3^2)P_1$$

Then, if the pressure $P_2$ in the head-side pressure chamber 18 is discharged as shown in FIG. 6C, there is no force acting on the piston 14 downward. Therefore, the load W is pulled up to a lifting stroke end by operating force due to air pressure in the rod-side pressure chamber 19 and retained there.

In this case, it is necessary that $$mg < \pi/4(D_1^2 - D_2^2)P_1.$$

Figure 7A:
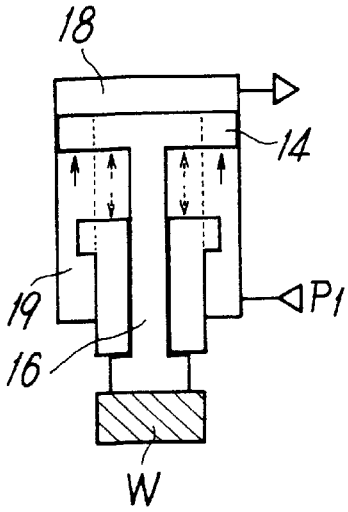
FIGS. 7A to 7C are explanatory views of lowering operation of the load in FIGS. 6A to 6C.
Figure 7B:
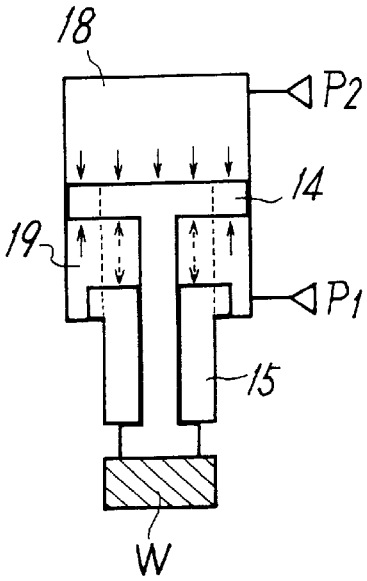

If the load W at the lifting stroke end as shown in FIG. 7A is lowered via the intermediate stop position, air pressure of pressure $P_2$ may be sent to the head-side pressure chamber 18 as shown in FIG. 7B. As a result, the load W stops in the intermediate stop position.

Figure 7C:
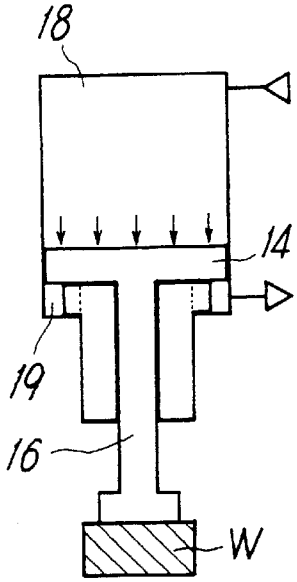
Figure 8:
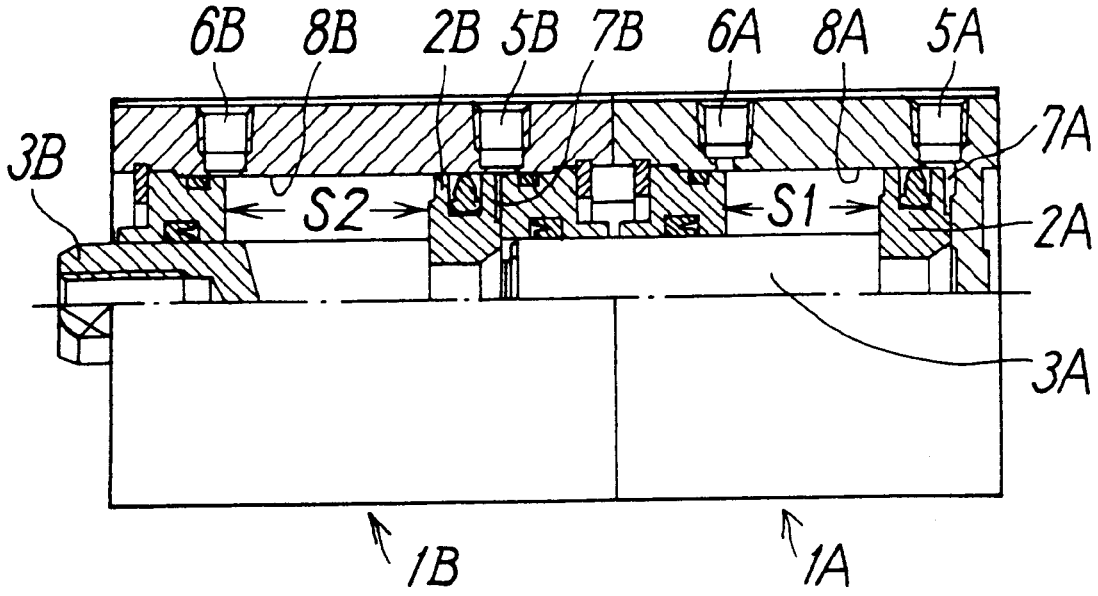
FIG. 8 PRIOR ART
FIG. 8 is a sectional view of an upper half portion of a known dual stroke cylinder.

If pressure $P_1$ in the rod-side pressure chamber 19 is discharged to the outside as shown in FIG. 7C, the load W moves to the lowering stroke end and stops there.

Next, by reference to FIGS. 1 to 3, operation in a case in which the dual stroke cylinder is used not for lifting in an arbitrary orientation in which the piston 14 does not directly receive the weight of the load in the intermediate stop position and the rod 16 is oriented horizontally or in other arbitrary directions will be described.

In this case too, if the weight of the load or force equal to the weight acts on the rod 16, it is possible to supply/discharge necessary fluid pressure to and from the pressure chambers 18 and 19 in view of operations in the above cases of pushing up of the load by the upward rod and pulling up of the load by the downward rod 16.

FIG. 1 shows a state in which compressed air of pressure $P_1$ is supplied from the port 19A to the rod-side pressure chamber 19 and air in the head-side pressure chamber 18 is discharged from the port 18A to the outside. The piston 14 and the rod 16 are in the end position of the return stroke by operating force of air pressure that acts on the pressure receiving face on the rod 16 side of the piston 14.

On the other hand, the sleeve 15 is biased in a driving stroke direction (leftward in FIG. 1) by operating force of air pressure that acts on the head-side pressure receiving area. However, because a pressure receiving area of the piston 14 is larger than a pressure receiving area of the sleeve 15, the sleeve 15 stops in such a position that the tip end portion 23 is engaged with the large-diameter portion 17 of the rod 16.

In this state, if compressed air of pressure $P_2$ that is lower than the pressure $P_1$ and satisfies a condition of $$\pi/4(D_2^2-D_3^2)P_1+\pi/4D_1^2P_2>\pi/4(D_1^2-D_3^2)P_1$$

is supplied from the port 18A to the head-side pressure chamber 18, the piston 14 and the rod 16 move in the driving direction. As a result, the sleeve 15 also moves in the same direction, the head-side engaging portion 22 comes into contact with t he en d face of the rod-side pressure chamber 19, and the piston 14 and the rod 16 stop in the intermediate position as shown in FIG. 2.

In this case, it is basically necessary to introduce pressure that satisfies $$\pi/4D_1^2P_2<\pi/4(D_1^2-D_3^2)P_1$$

and $$\pi/4(D_2^2-D_3^2)P_1>\pi/4(D_1^2-D_3^2)P_1\pi/4D_1^2P_2$$

into both the pressure chambers 18 and 19. However, it is not especially necessary to adjust the pressure if the rod 16 stops in that position by friction force or the like.

If compressed air in the rod-side pressure chamber 19 is discharged from the port 19A to the outside in the state shown in FIG. 2, the piston 14 and the rod 16 move further in the driving direction and stop when the pressure receiving face on the rod 16 side of the piston 14 comes into contact with the flange portion 22 of the sleeve 15 as shown in FIG. 3.

If necessary compressed air is supplied and discharged to and from both the pressure chambers 18 and 19 in order reverse to the above order in the state shown in FIG. 3, it is possible to return the p is ton 14, rod 16 and sleeve 15 to the state shown in FIG. 1 via the intermediate stop position.

Although operating force necessary for driving the load is not taken into consideration in the above description, it is actually necessary to introduce necessary pressure to the pressure chambers on the head side and the rod 16 side of the piston 14 in view of the operating force necessary for driving the load acting on the piston 14. This is also true for the case in which the load is moved up and down with the rod 16 oriented vertically upward or downward.

In the dual stroke cylinder 11 having the above structure, because only the two ports 18A and 19A are necessary to be provided to the cylinder 12, it is possible to make connection of pipes to the ports and a control system for controlling actuation of the cylinder simple and low-priced. Furthermore, because the rod 16 can be stopped in the intermediate position of the driving stroke by supplying and discharging compressed air to and from the two ports 18A and 19A, the dual stroke cylinder 11 can be operated in much the same way a normal fluid pressure cylinder for supplying and discharging compressed air from and to the two ports is operated.

What is claimed is:

1. A dual stroke cylinder comprising:

a cylinder body having therein a cylinder bore and a small-diameter rod hole connected to one end of said cylinder bore;

a piston for airtightly sliding in said cylinder bore;

a head-side pressure chamber and a rod-side pressure chamber disposed on opposite sides of said piston;

a pair of ports individually communicating with said respective pressure chambers;

a sleeve for intermediate stop, airtightly passing through said rod hole for forward and rearward movements, and having a base end portion positioned in said rod-side pressure chamber, a tip end portion extending to an outside of said cylinder body, and a pressure receiving portion with a diameter smaller than that of said piston on said base end portion side;

a rod airtightly passing through said sleeve for sliding relatively to said sleeve and having a base end portion connected to said piston and a tip end portion extending to said outside of said cylinder body;

stop means for stopping said sleeve at a forward end; and first lock means for locking said rod and said sleeve to each other at a rearward end when said rod moves rearward relatively to said sleeve and second lock means for locking said rod and said sleeve to each other at a forward end when said rod moves forward relatively to said sleeve.

2. A dual stroke cylinder according to claim 1, wherein said stop means for stopping said sleeve at said forward end is a flange portion formed on an outer periphery of said base end portion of said sleeve and said flange portion is locked to an inner end of said rod hole in said cylinder body at said forward end.

3. A dual stroke cylinder according to claim 1, wherein said first lock means is a large-diameter portion formed at said tip end of said rod, said large-diameter portion comes into contact with said tip end portion of said sleeve at said rearward end of said rod, said second lock means is said piston, and said piston comes into contact with a rear end portion of said sleeve at said forward end of said rod.

4. A dual stroke cylinder according to claim 2, wherein said first lock means is a large-diameter portion formed at said tip end of said rod, said large-diameter portion comes into contact with said tip end portion of said sleeve at said rearward end of said rod, said second lock means is said piston, and said piston comes into contact with a rear end portion of said sleeve at said forward end of said rod.

5. A dual stroke cylinder according to claim 1, wherein said dual stroke cylinder is disposed vertically with said rod oriented upward for lifting and lowering a load by pushing up and fluid supply means for supplying pressure fluid of equal pressure to said two ports is connected to said two ports.

6. A dual stroke cylinder according to claim 1, wherein said dual stroke cylinder is disposed vertically with said rod oriented downward for lifting and lowering a load by pulling up, fluid supply means for supplying pressure fluid of lower pressure to said head-side port communicating with said head-side pressure chamber and pressure fluid of higher pressure to said rod-side port communicating with said rod-side pressure chamber is connected to said two ports, and a difference between said pressures of said pressure fluid is a pressure difference necessary for stopping said piston in an intermediate stop position.

7. A dual stroke cylinder according to claim 1, wherein said dial stroke cylinder is disposed in such a state that said piston does not directly receive a weight of a load in an intermediate position, fluid supply means for supplying pressure fluid of lower pressure to said head-side port communicating with said head-side pressure chamber and pressure fluid of higher pressure to said rod-side port communicating with said rod-side pressure chamber is connected to said two ports, and a difference between said pressures of said pressure fluid is a pressure difference necessary for stopping said piston in an intermediate stop position.

* * * * *